US008132433B2

(12) United States Patent
Andersen

(10) Patent No.: US 8,132,433 B2
(45) Date of Patent: Mar. 13, 2012

(54) PROTECTIVE DEVICE FOR CONCEALING A ZIPPER PULL

(76) Inventor: Joan Andersen, Fort Worth, TX (US)

( * ) Notice: Subject to any disclaimer, the term of this patent is extended or adjusted under 35 U.S.C. 154(b) by 251 days.

(21) Appl. No.: 11/466,092

(22) Filed: Aug. 21, 2006

(65) Prior Publication Data

US 2008/0092346 A1 Apr. 24, 2008

(51) Int. Cl.
*D06F 35/00* (2006.01)

(52) U.S. Cl. ..... 68/235 R; 24/113 MP; 24/90

(58) Field of Classification Search ..... None
See application file for complete search history.

(56) References Cited

U.S. PATENT DOCUMENTS

| | | | | |
|---|---|---|---|---|
| 2,024,533 | A * | 12/1935 | Manoogian | 68/235 R |
| 2,189,467 | A * | 2/1940 | Jacobs | 68/235 R |
| 2,667,906 | A * | 2/1954 | Stiller | 150/150 |
| 2,909,203 | A * | 10/1959 | Reaves | 150/150 |
| 3,063,487 | A * | 11/1962 | Mullin | 150/150 |
| 3,757,388 | A * | 9/1973 | Wolny | 24/113 MP |
| 4,033,013 | A * | 7/1977 | Peterson | 24/303 |
| 4,368,562 | A * | 1/1983 | Minami | 403/354 |
| D396,202 | S * | 7/1998 | Lindsay | D11/228 |
| 5,901,417 | A * | 5/1999 | Alexiou | 24/90.5 |
| 6,361,210 | B2 * | 3/2002 | Denko | 383/35 |
| 7,203,999 | B2 * | 4/2007 | Bagot | 24/113 R |
| 2004/0020017 | A1 | 2/2004 | Nedbal et al. | |
| 2004/0264815 | A1 | 12/2004 | Gibeau | |
| 2005/0040559 | A1 | 2/2005 | Yang | |
| 2005/0050698 | A1 * | 3/2005 | Muratsubaki et al. | 24/429 |

FOREIGN PATENT DOCUMENTS

| | | |
|---|---|---|
| JP | 11169588 | 6/1999 |
| WO | WO 95/33881 A2 | 12/1995 |

* cited by examiner

*Primary Examiner* — Jack Lavinder
(74) *Attorney, Agent, or Firm* — Law Office of J.D. Pemberton; John Pemberton

(57) ABSTRACT

The present invention is directed to a protective device for a fastener located on an article. The protective device includes a body having an exterior surface and an interior surface. The interior surface defines an interior space sufficient to surround at least a portion of a fastener. The body also includes an aperture which may be moved to an open position by squeezing or moving a portion of the body, and moved to a closed position by releasing a portion of the body. The device protects the interior walls of a washing or drying machine during washing or drying of the article.

17 Claims, 7 Drawing Sheets

PROTECTIVE DEVICE FOR CONCEALING A ZIPPER PULL

BACKGROUND OF INVENTION

1. Field of Invention

This invention relates to a concealment device for a fastener, and more particularly, to a protective and concealment device for a zipper pull.

2. Description of Related Art

Millions of people use washing and drying machines on a regular basis to wash clothing and other articles. A large number of machine washable articles contain buttons, clasps, zippers having zipper pulls, or other fasteners. During the washing and drying machine cycles, the articles being washed or dried are agitated within the machines. As the garments are tossed about within the washing or drying machine, any fastener located on the articles comes into contact with the interior walls of the machine and creates dents and/or scratches on these interior walls. In addition, as the fasteners strike the interior walls of the washer and/or dryer, a loud, disturbing noise is often produced. What is needed is a device that can protect the interior walls of a washing or drying machine and reduce the noise of a fastener striking the interior walls of the washing or drying machine.

SUMMARY OF INVENTION

The present invention solves the above-described problem by providing a protective device that conceals a fastener located on an article. The protective device comprises a body having an exterior surface and an interior surface. The interior surface defines an interior space sufficient to surround at least a portion of a fastener. The body also includes an aperture which may be moved to an open position by squeezing or moving a portion of the body and moved to a closed position by releasing a portion of the body. Because the device surrounds at least a portion of a fastener, the device protects the interior walls of a washing or drying machine during the washing or drying of the article.

More particularly, the protective device body may include a mechanism which allows the aperture to be moved to an open position by squeezing or moving a portion of the body, and permits the aperture to be moved to a closed position by releasing a portion of the body. The body may further include a closure located proximate the aperture for maintaining the aperture in a closed position. In addition, the body may include a flexible panel region proximate to the aperture to aid in opening the aperture. The protective device may be in the shape of a sports ball, an animal, a piece of food, an insect, an insect a top a piece of food, a heart, or almost any other shape that may be aesthetically pleasing or attractive to a consumer.

Other features and advantages of the present invention will become apparent upon reading the following detailed description of embodiments of the invention when taken in conjunction with the appended claims. The novel features believed characteristic of the invention are set forth in the appended claims. The invention itself, however, as well as further objectives and advantages thereof, will be best understood by reference to the following detailed description of illustrative embodiments when read in conjunction with the accompanying drawings.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Figure 1:
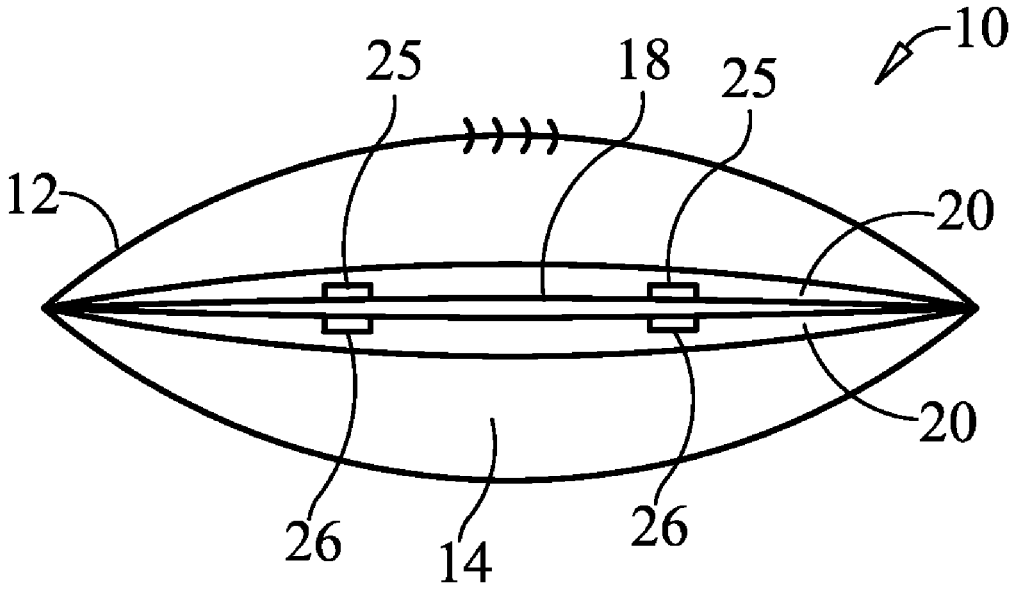
FIG. 1 is a front view of a protective device made in accordance with an embodiment of the present invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Figure 3:
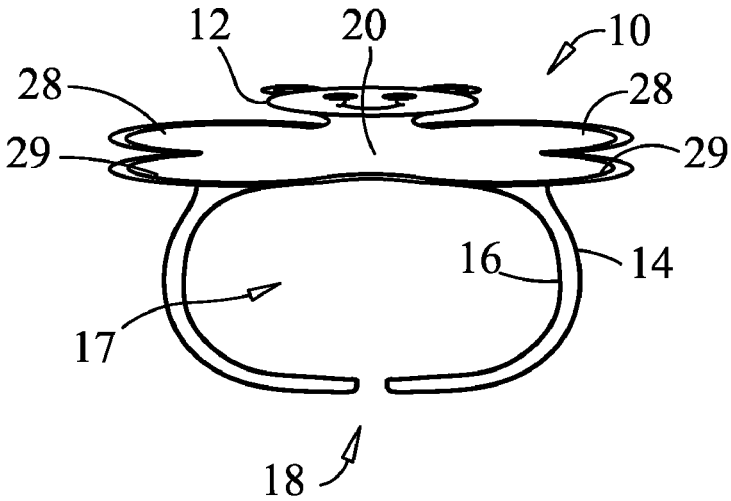
FIG. 3 is a side view of a protective device made in accordance with an alternative embodiment of the present invention.

Referring to FIG. 1, shown is protective device 10 comprising body 12. Body 12 may be comprised of any flexible material that is durable enough to withstand tumbling within a washing and drying machine cycle, and not cause any damage to the interior walls of the washing or drying machine during use. Suitable materials body 12 may be comprised of include, but are not limited to rubber, plastic, or acrylic. Preferably, body 12 is comprised of rubber. Body 12 has an exterior surface 14 and an interior surface 16 (FIG. 3). Interior 16 surface defines interior space 17. Interior space 17 is sufficient to surround at least a portion of a fastener such as a button, clasp, or zipper pull.

Aperture 18 is located on body 12 and may be any shape that allows at least a portion of the fastener to pass through aperture 18 and fit within interior space 17 of device 10. Preferably, aperture 18 is in the shape of a slit and extends from one side of body 12 to the opposite side of body 12 transversing the middle section of body 12.

Body 12 may include flexible panel region 20 to aid in the opening of aperture 18. Preferably, flexible panel region 20 is located proximate aperture 18 for maximum aid in opening aperture 18 and aperture 18 bisects or divides flexible panel region into at least two parts.

Figure 6A:
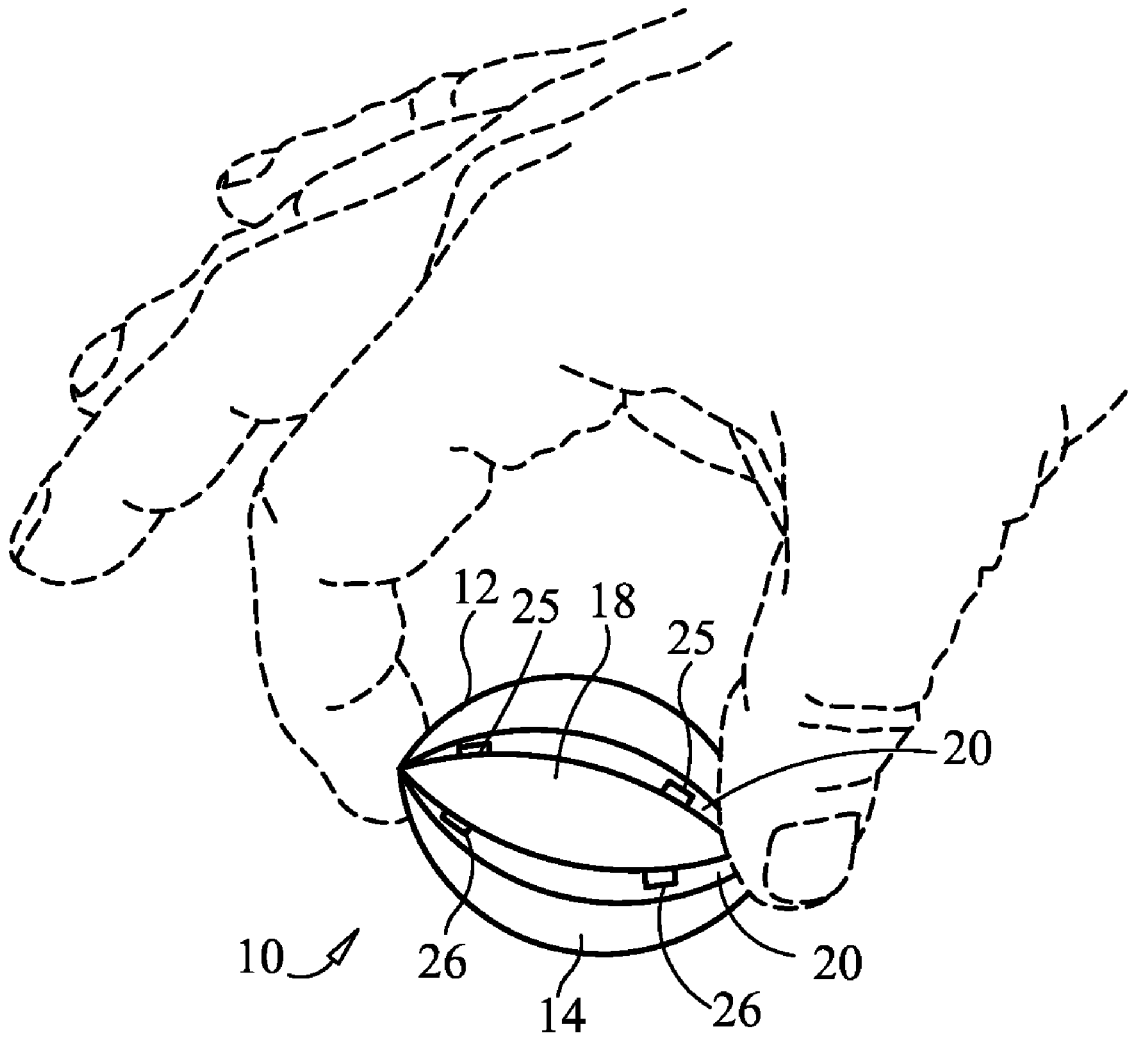
FIG. 6A depicts the opening of an aperture of a protective device made in accordance with an embodiment of the present invention.

As shown in FIG. 6A, when a portion of body 12, in this example, two opposite ends of device 10, are squeezed or moved, flexible panel region 20 is stressed and put under tension. Because flexible panel region 20 is bisected by aperture 18, when flexible panel region 20 is put under tension, the two bisected parts of flexible panel region 20 move in opposite directions. As the two bisected parts of panel region 20 move in opposite directions, they cause aperture 18 to widen to an open position.

Figure 6B:
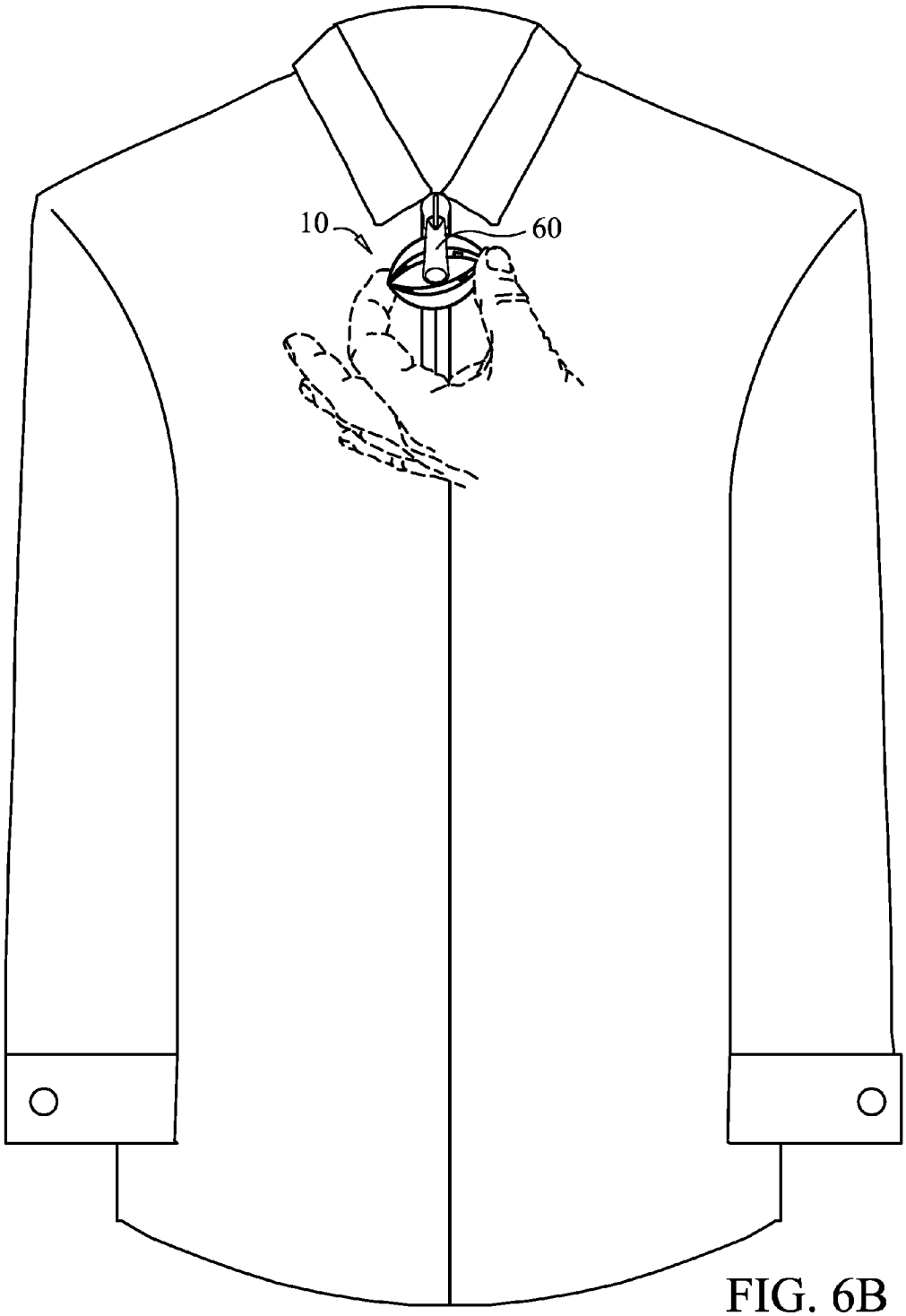
FIG. 6B depicts a protective device being secured to a fastener in accordance with an embodiment of the present invention.
Figure 6C:
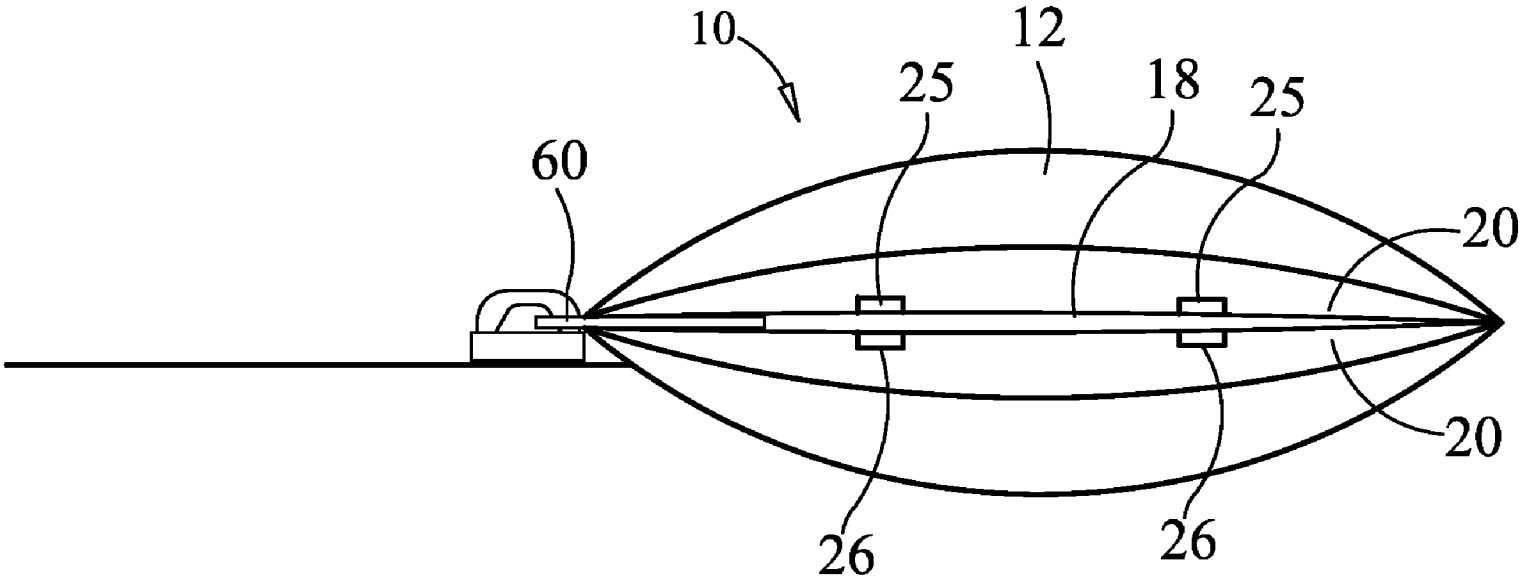
FIG. 6C depicts a protective device secured to a fastener in accordance with an embodiment of the present invention.

While aperture 18 is in an open position, protective device 12 may be placed over a fastener similar to fastener 60 shown in FIG. 6B. Fastener 60 is a zipper pull as is known in the art. When body 12 is released and flexible panel region 20 is not longer under tension, aperture 18 returns to a closed position wherein body 12 surrounds at least a portion of fastener 60, a shown in FIG. 6C. Depending upon the type of fastener located on the article, the entire fastener may be covered and concealed by protective device 10, or only a portion of the fastener may be covered by protective device 10.

As the article with fastener 60 is agitated in a washing or drying machine, protective device 10 remains on the fastener, continuing to surround at least a portion of fastener 60 and protects the interior walls of the washing or drying machine during use. As a result, the interior walls of the washing or drying machine are protected from being dented, scratched or otherwise damaged by the fastener. In addition, any noise resulting from the fastener striking the interior walls of the washing or drying machine is prevented or muted.

In one embodiment, body 12 may include closure 26 located proximate to aperture 18. Closure 26 aids in keeping aperture 18 closed. Closure 26 may be adhesive or one part of a mechanical attachment means such as a snap, button, zipper, hook-and-loop, Velcro®, magnet, or any other similar mechanical fastener that requires the mating of two parts.

If closure 26 is one part of a mechanical attachment means, then one side may contain closure 26 while the opposite side contains mating closure 25. Mating closure 25 is the mating part of closure 26. For example, if closure 26 is a hook, then mating closure 25 may be a loop. Preferably, closure 26 is comprised of a plurality of magnets located along an edge(s) of aperture 18, wherein closure 26 is one set of magnets with one polarity and mating closure 25 is a mating set of magnets with the opposite polarity. The force of attraction between the magnets holds the aperture 18 in a closed position. Any closure 26 known to those having skill in the art and suitable for the present invention may be used.

Body 12 may be any shape which allows protective device 10 to perform its intended function. Suitable shapes for body 12 include, but are not limited to a sports ball, such as a football, basketball, baseball, tennis ball, golf ball or soccer ball; an animal, such as a bear, cat, mouse, dog, alligator, turtle, dinosaur, monkey, bird, horse, sheep, donkey, clam, or elephant; an insect, such as a butterfly, ladybug, beetle, spider, or worm; an insect atop a piece of food, such as a butterfly atop a piece of fruit; a piece of food, such as an apple, orange, banana, or pear; an angel or any other shape or design such as a snowflake that may be aesthetically pleasing or attractive to a consumer.

Figure 2:
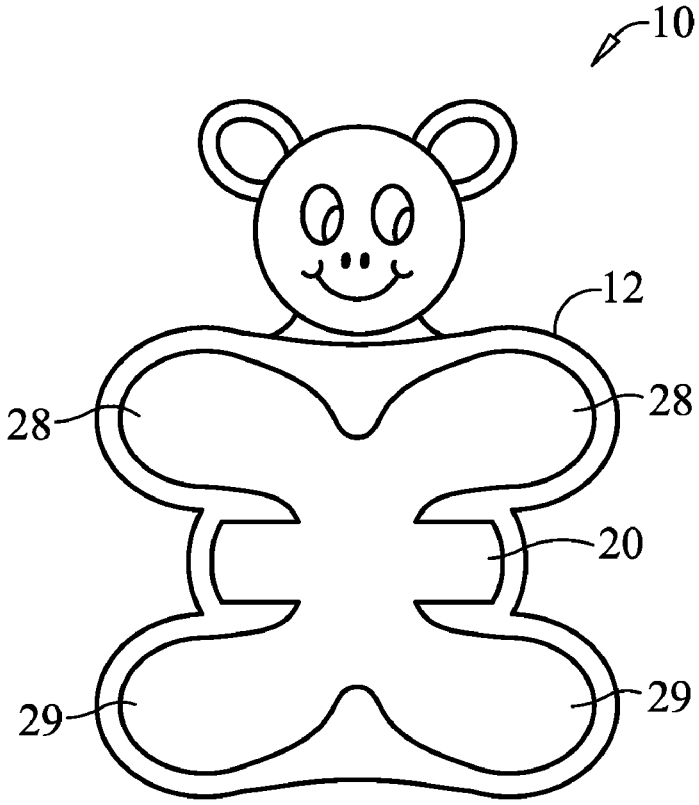
FIG. 2 is a front view of a protective device made in accordance with an alternative embodiment of the present invention.

In an alternate embodiment, shown in FIGS. 2 and 3, protective device 10 is in the shape of a teddy bear having opposing arms 28 and opposing legs 29. Flexible panel region 20, seen in more detail in FIG. 3, has a circular profile with a gap or opening at one end wherein the opening is aperture 18 and aperture 18 bisects flexible panel region 20. By simultaneously squeezing opposing arms 28 toward each other and/or squeezing opposing legs 29 legs toward each other, flexible panel region 20 is stressed and put under tension. Because flexible panel region 20 is bisected by aperture 18, when flexible panel region 20 is put under tension, the two bisected parts of flexible panel region 20 move in opposite directions. As the two bisected parts of panel region 20 move in opposite directions, they cause aperture 18 to widen to an open position.

While aperture 18 is in an open position, protective device 12 may be placed over a fastener. Then, when the arms and legs are released, aperture 18 is returned to a closed position and is secured around a least a portion of the fastener. Aperture 18 may be opened by simultaneously squeezing opposing arms 28 toward each other and/or squeezing opposing legs 29 legs toward each other, and whereby releasing opposing arms 28 and/or opposing legs 29 causes the aperture to close.

In this embodiment, flexible panel region 20 is centrally located between opposing arms 28 and/or opposing legs 29, near the stomach area of the bear. The configurations and methods described above for opening and closing aperture 18 may be used for any shape body 12 having four appendages, such as a cat or dog. In the particular embodiment shown in FIG. 3, aperture 18 is preferably located on the back surface of the teddy bear.

Figure 4:
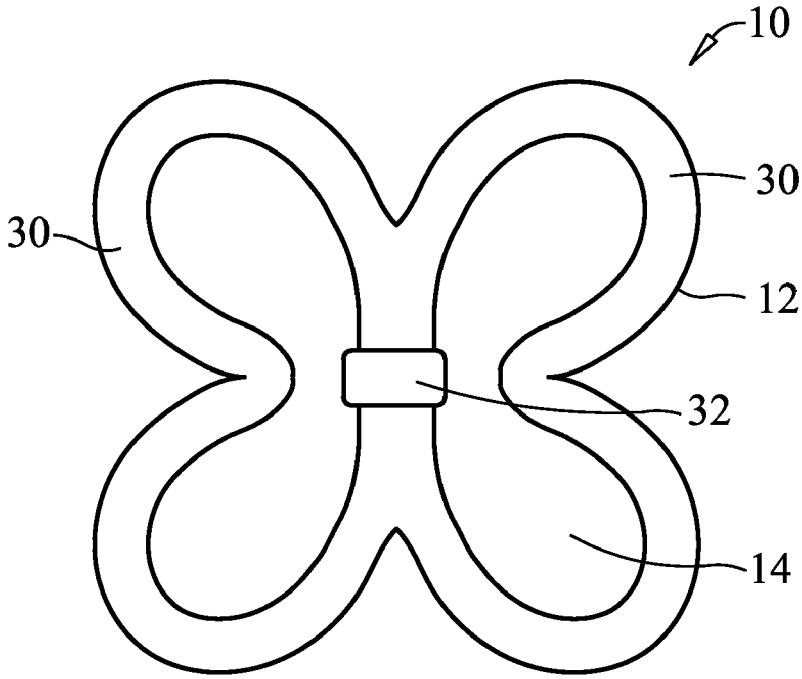
FIG. 4 is a front view of a protective device made in accordance with an alternative embodiment of the present invention.
Figure 5:
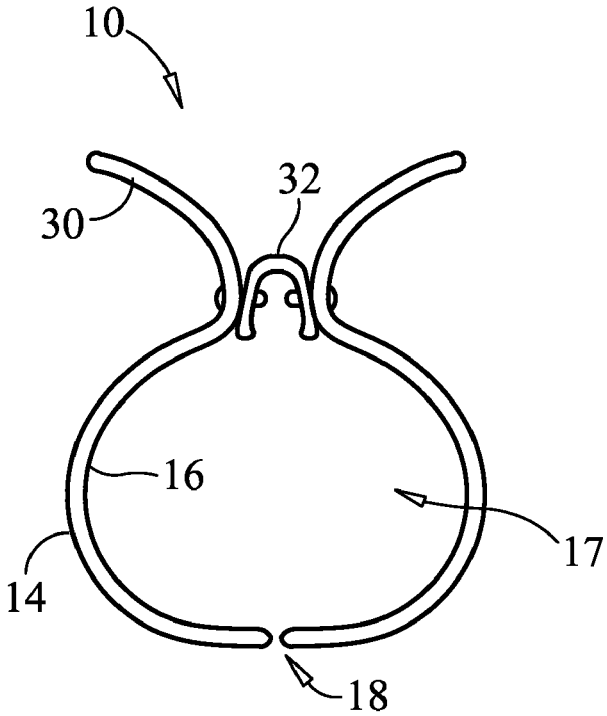
FIG. 5 is a side view of a protective device made in accordance with an alternative embodiment of the present invention.

Body 12 of protective device 10 may also be in the shape of an animal, insect or other entity which comprises wings. For example, as illustrated in FIGS. 4 and 5, body 12 may be in the shape of a butterfly. In this embodiment, squeezing wings 30 toward each other causes aperture 18 to open, and releasing wings 30 causes aperture 18 to close. Body 12 includes flexible panel region 20, or alternatively, as shown in FIGS. 4 and 5, flexible pin 32, located between wings 30, wherein pin 32 allows movement of wings 30 toward each other. As wings 30 are moved towards each other, they cause aperture 18 to widen into an open position and accommodate a fastener.

Figure 7:
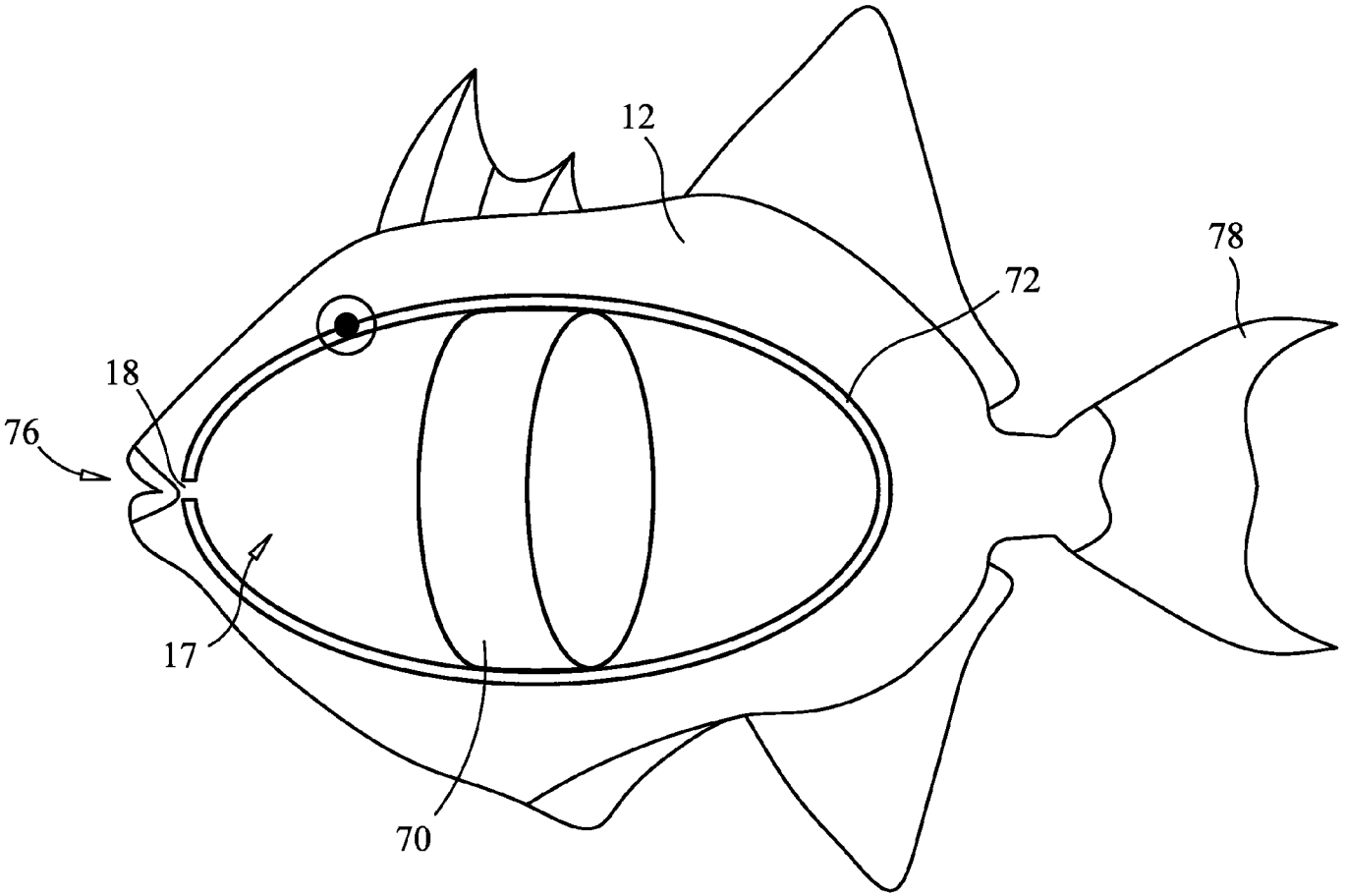
FIG. 7 is a side cross sectional view of a protective device made in accordance with an alternative embodiment of the present invention.

In another embodiment, shown in FIG. 7, protective device body 12 may be in the shape of an animal with its mouth open, e.g. an alligator, wherein protective device 10 contains vertical band 70 and horizontal band 72. If protective device body 12 is in the shape of a fish, then vertical band 70 is proximate to the mid section of the fish or near the gills if present. Horizontal band 72 extends from mouth 76 of the fish to tail 78 of the fish. When vertical band 70 is squeezed inward, it extends or elongates. The elongation pushes on horizontal band 72 and causes aperture 18 to widen in an open position wherein a fastener may be inserted through aperture 18 and into interior space 17

Protective device 10 of the present invention may be used to cover and conceal a wide array of fasteners, including but not limited to, buttons, clasps, and zipper pulls. Protective device 10 may also be used to conceal any item, including decorative items, located on an article which may cause damage to a washing or drying machine. The fastener, or alternative item to be concealed, may be located on any article, including, but not limited to a piece of clothing, such as a shirt, blouse, pair of pants, or shoe, a sleeping bag, blanket, curtain, or linens.

It should be understood that the foregoing relates to exemplary embodiments of the invention and that modifications may be made without departing from the spirit and scope of the invention as set forth in the following claims.

What is claimed is:

1. A method comprising:

locating an article to be placed in a washing machine or a drying machine;

locating a fastener on the article;

enveloping a portion of the fastener with a protective device, the protective device comprising:

an interior surface defining an interior space sufficient to surround at least a portion of a fastener, wherein the protective device does not surround the entire fastener; and an aperture that may be moved to an open position by squeezing or moving a portion of the protective device, and moved to a closed position by releasing the portion of the protective device; and placing the article in the washing machine or the drying machine, wherein as the article and the fastener are agitated in the washing machine or the drying machine, the protective device continues to envelope the fastener.

2. The method of claim 1 wherein the protective device has a first end and a second end that is opposite of the first end and the aperture is located on the first end of the protective device and the portion of the protective device is located on the second end of the protective device.

3. The method of claim 1 further comprising:

removing the article from the washing machine or the drying machine;

removing the protective device from the fastener;

locating a second article with a second fastener;

enveloping a portion of the second fastener with the protective device; and placing the second article in the washing machine or the drying machine, wherein as the second article and the second fastener are agitated in the washing machine or the drying machine, the protective device continues to envelope the second fastener.

4. The method of claim 1, wherein the protective device contains a closure and the closure comprises a post and a latch.

5. The method of claim 1, wherein the protective device contains a closure and the closure comprises magnets located along an edge of the aperture for maintaining the aperture in a closed position.

6. The method of claim 1, wherein the aperture is a slit.

7. The method of claim 1, wherein at least a portion of the protective device is comprised of rubber or plastic and is heat resistent.

8. The method of claim 1, wherein the protective device contains a flexible panel region to aid in opening the aperture.

9. The method of claim 8, wherein the flexible panel region is located proximate the aperture.

10. The method of claim 1, wherein the protective device is in the shape of a sports ball, an animal, a piece of food, an insect, an insect atop a piece of food, or a heart.

11. The method of claim 1, wherein the protective device is in the shape of a football, basketball, baseball, tennis ball, golf ball or soccer ball.

12. The method of claim 1, wherein the protective device is in the shape of a butterfly, ladybug, beetle, or spider.

13. The method of claim 1, wherein the protective device is in the shape of a butterfly, the aperture is opened by squeezing two wings of the butterfly toward each other, and the aperture is closed when the two wings are released.

14. The method of claim 1, wherein the protective device is in the shape of a butterfly atop a piece of fruit, the aperture is opened by squeezing two wings of the butterfly toward each other, and the aperture is closed when the two wings are released.

15. The method of claim 1, wherein the protective device is in the shape of a bear, alligator, dinosaur, monkey, turtle, cat, mouse, or dog.

16. The method of claim 1, wherein the protective device is in the shape of a teddy bear, the teddy bear has two arms and two legs, the aperture is opened by simultaneously squeezing the two arms toward each other and squeezing the two legs toward each other, and the aperture is closed when the arms and legs are released.

17. The method of claim 1, wherein the protective device is in the shape of an angel, the angel comprises two wings, the aperture is opened by squeezing the wings toward each other, and the aperture is closed when the wings are released.

* * * * *